US005980030A

United States Patent [19]

Fujii

[11] Patent Number: 5,980,030

[45] Date of Patent: Nov. 9, 1999

[54] PRINTER

[75] Inventor: Takeo Fujii, Tokyo, Japan

[73] Assignee: Oki Data Corporation, Tokyo, Japan

[21] Appl. No.: 08/682,253

[22] Filed: Jul. 17, 1996

[30] Foreign Application Priority Data

Jul. 21, 1995 [JP] Japan ..... 7-185413

[51] Int. Cl.[6] ..... B41J 2/175

[52] U.S. Cl. ..... 347/85

[58] Field of Search ..... 347/85–87, 7

[56] References Cited

U.S. PATENT DOCUMENTS 4,187,511 2/1980 Robinson ..... 347/7

5,712,667 1/1998 Sato ..... 347/7

*Primary Examiner*—N. Le

*Assistant Examiner*—Michael Nghiem

*Attorney, Agent, or Firm*—Akin, Gump, Strauss, Hauer & Feld, L.L.P.

[57] ABSTRACT

A recording apparatus has a print head with an ink tank for supplying ink to the print head. The ink tank is carried together with a print head on a carriage, which is moved over a print medium so that the print head prints data on the print medium. The ink tank has an ink-empty sensor which outputs a first signal upon detecting that the ink in the ink tank has decreased to a lower limit. A controller causes the carriage to move to an ink-refilling position in response to the first signal. Then, the controller causes an ink-refilling mechanism to refill the ink tank with ink from an ink reservoir located above the ink tank. The ink tank also has an ink-full sensor which outputs a second signal upon detecting that the ink in the ink tank has increased to an upper limit. The ink-refilling mechanism stops an ink-refilling operation in response to the second signal. A timer may be used in place of the ink-full sensor. The timer outputs an output a predetermined time length after initiation of the ink-refilling operation, and the ink-refilling mechanism completes ink-refilling operation in response to the output of the timer.

22 Claims, 9 Drawing Sheets

PRINTER

BACKGROUND OF THE INVENTION

The present invention relates to recording apparatuses equipped with an ink tank, including ink jet printers and composite apparatuses incorporating an ink jet printer. In such apparatuses, a carriage carries a print head and an ink tank thereon. The ink tank supplies ink to the print head and the print head performs printing operation. The apparatus indicates to the user when the ink tank becomes empty, prompting the user to replace the ink tank.

The carriage moves at a high speed and therefore places limitations on the capacity of the ink tank carried on the carriage. The ink tank usually has a capacity in the range of only 50–150 cc at most.

The limited capacity of an ink tank is a problem with a conventional recording apparatus equipped with an ink tank. Frequent replacement of the ink tank is a nuisance in businesses where printing of documents is performed day and night. An unmanned operation of the recording apparatus is required in a situation where a large volume of information is received from overseas during night and weekend. Therefore, a conventional recording apparatus equipped with an ink tank is not suitable for tasks in such a situation.

SUMMARY OF THE INVENTION

An object of the invention is to provide a recording apparatus equipped with an ink tank, which is capable of continued operation without human attendance.

A recording apparatus has a print head with an ink tank for supplying ink to the print head. The ink tank is carried together with a print head on a carriage, which is moved over a print medium so that the print head prints data on the print medium. The ink tank has an ink-empty sensor which outputs a first signal upon detecting that the ink in the ink tank has decreased to a lower limit. A controller causes the carriage to move to an ink-refilling position in response to the first signal. Then, the controller causes an ink-refilling mechanism to refill the ink tank with ink from an ink reservoir located above the ink tank. The ink tank also has an ink-full sensor which outputs a second signal upon detecting that the ink in the ink tank has increased to an upper limit. The ink-refilling mechanism stops an ink-refilling operation in response to the second signal.

A timer may be used in place of the ink-full sensor. The timer outputs an output a predetermined time length after initiation of the ink-refilling operation, and the ink-refilling mechanism completes ink-refilling operation in response to the output of the timer.

DETAILED DESCRIPTION OF THE INVENTION

Embodiments of the invention will now be described with reference to the drawings. Like elements have been given like numerals throughout the drawings.

First Embodiment

Figure 1:
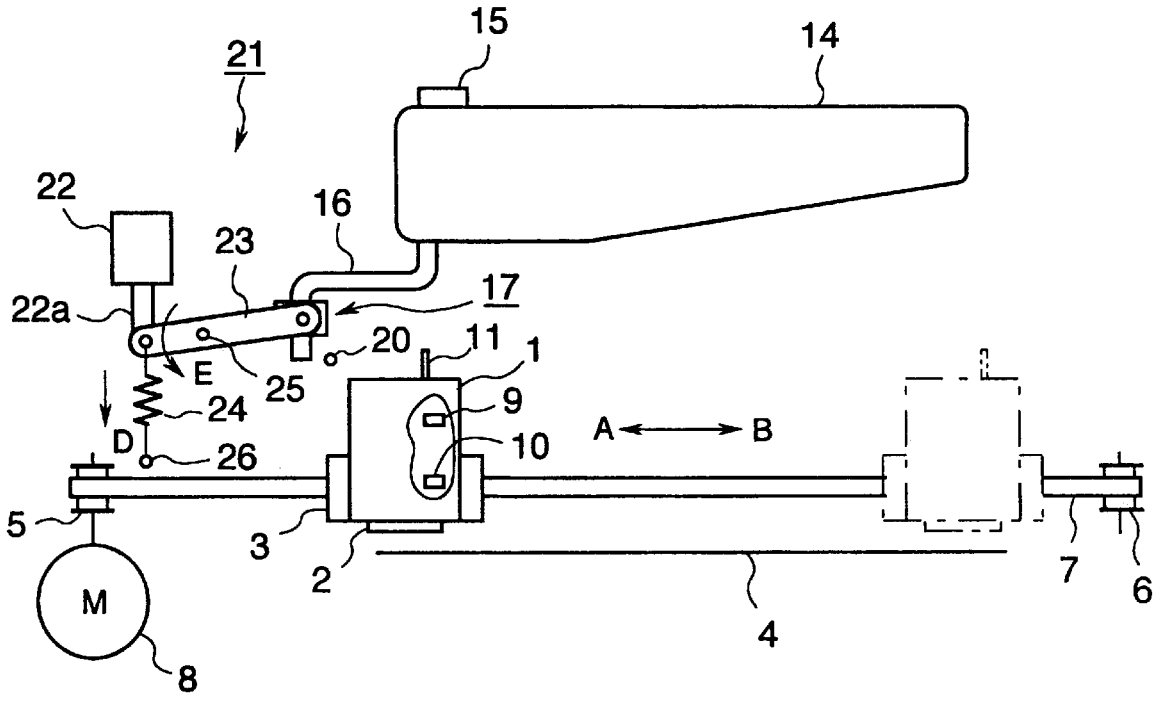
FIG. 1 illustrates a general construction of a first embodiment.

FIG. 1 illustrates a general construction of a first embodiment. The print head 2 is integral with an ink tank 1 and is carried on a carriage 3 which is adapted to move in directions shown by arrows A and B. The print head 2 is driven by a head driving means, not shown, to perform printing operation. The print head 2 is moved over print paper 4 to print data in the print area which varies from line to line depending on the print data. The print head 2 is moved by a carriage-moving means to an ink-refilling position (FIG. 5) when refilling the ink tank. The carriage-moving means includes primarily toothed pulleys 5 and 6, toothed belt 7, and spacing motor 8. The carriage 3 is fixed to the toothed belt 7 mounted on the pulleys 5 and 6. The toothed pulley 5 is secured to the motor shaft of the spacing motor 8 while the toothed pulley 6 is rotatably supported by a frame, not shown for free rotation. The print paper 4 is transported in a direction perpendicular to the direction shown by arrows A and B and perpendicular to the page of FIG. 1, and is also subject to line-feed operation performed by a line-feed motor, not shown.

Figure 2:
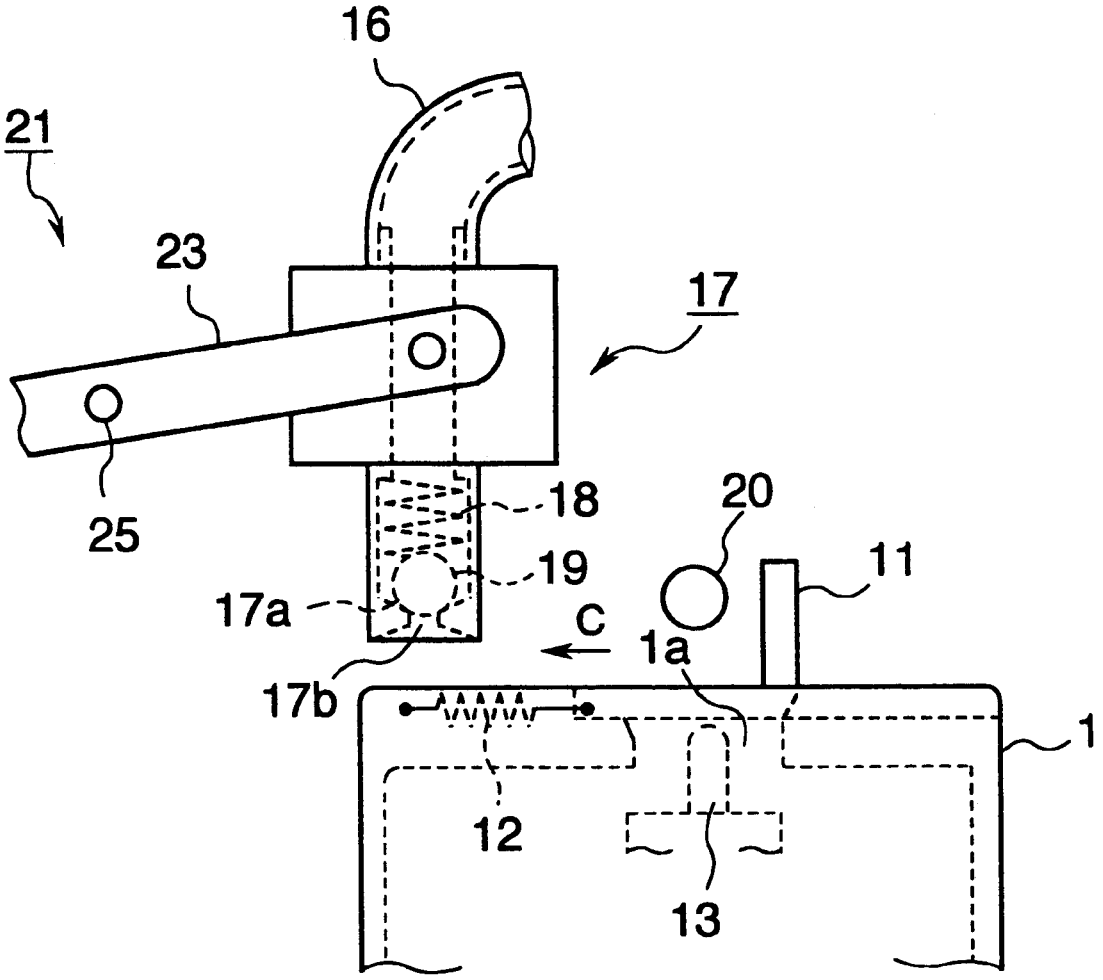
FIG. 2 illustrates a nozzle and ink tank approaching the nozzle.
Figure 3:
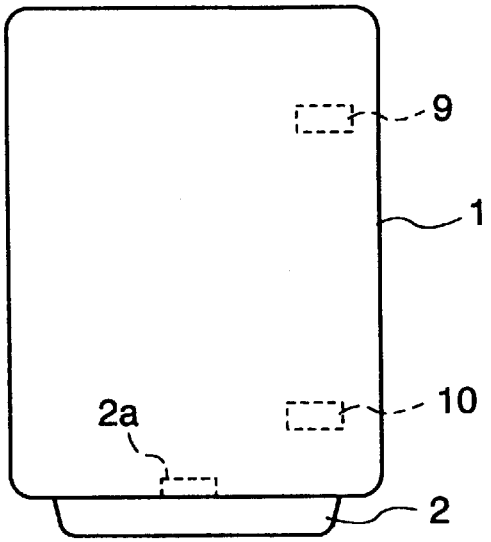
FIG. 3 shows an ink tank provided with an ink-full sensor and an ink-empty sensor.

As shown in FIG. 3, the ink tank 1 is provided with a common electrode 2*a* at the bottom thereof, electrode 10 close to but above the common electrode 2*a,* and electrode 9 above the electrode 10. Ink is absorbed in an ink-absorbing material such as felt held in the ink tank 1. Generally, ink for use in this type of print head has an electrical conductivity. Therefore, the electrical resistance between the electrode 9 and the common electrode 2*a* decreases significantly if the ink in the ink tank 1 increases to a level of the electrode 9. The electrical resistance between the electrode 10 and the common electrode 2*a* increases significantly if the ink in the ink tank 1 decreases to a level below the electrode 10. Thus, the electrode 9 and the common electrode 2*a* form an ink-full sensor 9*a* and the electrode 10 and the common electrode 2*a* form an ink-empty sensor 10*a*. Thus, the ink-full sensor 9*a* detects when the ink tank has been filled with ink up to a predetermined upper limit while the ink-empty sensor 10*a* detects when the ink in the ink tank has been decreased to a predetermined lower limit. The lower limit may be preferably set to a level so that several more pages of a predetermined paper size can still be printed after the ink-empty sensor 10*a* detects when the ink has decreased to the lower limit. The ink tank 1 has an ink-refilling opening 1*a* (FIG. 2) which is opened and closed by a lid 11. The lid 11 is of one piece construction and has an L-shaped cross section. The lid 11 is normally urged by a tension spring 12 in a direction shown by arrow C to close the ink-refilling opening 1*a*. A projection 13 extends upwardly in the ink tank 1 so that its free end is at the ink-refilling opening 1*a*.

As shown in FIG. 1, the ink-reservoir 14 is of a larger capacity than the ink tank 1 and is permanently installed above the ink tank 1 of the print head 2. The ink-reservoir 14 has a cap 15 on its top and a flexible tube 16 extending from its bottom. The tube 16 has a nozzle 17 attached to its free end. The ink reservoir 14, the flexible tube 16 and the nozzle 17 together comprise an ink refilling mechanism. As shown in FIG. 2, the nozzle 17 has a compression spring 18 and a ball 19 therein. The ball 19 is urged by the spring 18 against a seat 17*a* to close the nozzle hole 17*b* of the nozzle 17. A knock pin 20 fixedly projects from the frame of the printer, not shown, and serves as a stopper which abuts the lid 11 of the ink tank 1 to open the ink-refilling opening 1*a* when the carriage 3 moves in the direction shown by arrow A to the ink-refilling position (FIG. 5).

As shown in FIG. 1, a nozzle driver 21 includes an electromagnetic solenoid 22, lever 23, and tension spring 24. The lever 23 is rotatably supported on a shaft 25, and has one end pivotally connected to the nozzle 17 and the other end pivotally connected to a movable rod 22*a* of the electromagnetic solenoid 22. The nozzle 17 is located sufficiently away from the print area so that the nozzle 17 doses not disturb normal printing operation of the print head. The tension spring 24 is mounted between a post 26 provided on the frame and the movable rod 22*a*, so that the movable rod 22*a* is pulled by the spring 24 in a direction shown by arrow D when the electromagnetic solenoid 22 is not energized, causing the lever 23 to rotate in a direction shown by arrow E. Thus, the nozzle 17 is driven by the solenoid 22 to rotate about the shaft 25, thereby to move substantially vertically.

Figure 4A:
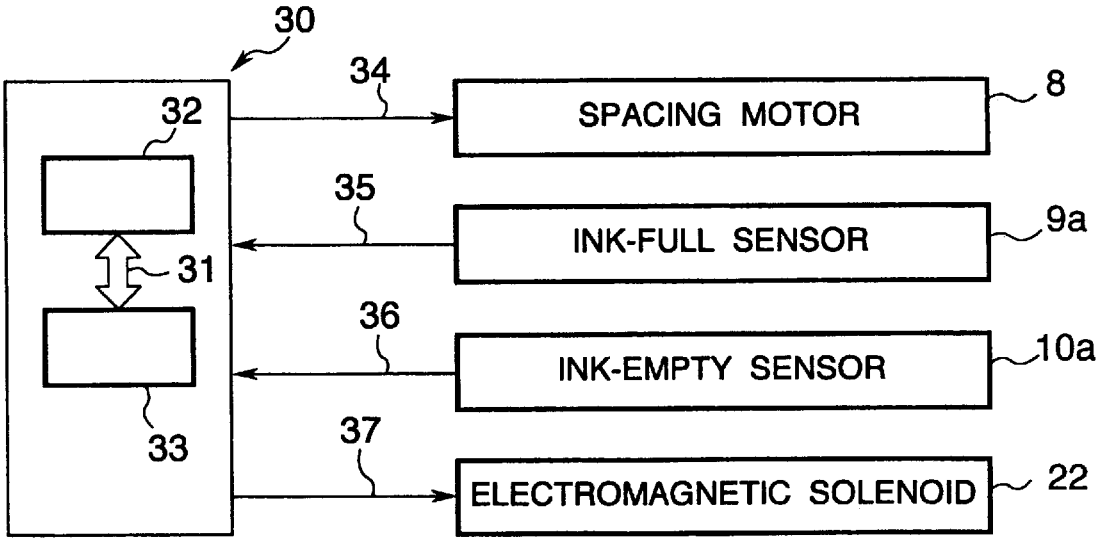
FIGS. 4A and 4B are block diagrams showing a controller of the first embodiment.

FIG. 4A is a block diagram showing a controller 30 of the first embodiment. The controller 30 takes the form of a programmed microcomputer and includes a central processing unit (referred to as CPU hereinafter) 32 and a memory 33 connected via bus lines 31. The controller 30 is connected with the spacing motor 8, ink-full sensor 9*a*, ink-empty sensor 10*a*, and electromagnetic solenoid 22, via signal lines 34–37, respectively. Under control of a control program stored in the memory 33, the CPU 32 drives the spacing motor 8 in response to the output of the ink-empty sensor 10*a* and accurately places the ink tank 1 at the ink-refilling position. The CPU 32 then causes the electromagnetic solenoid 22 to insert the nozzle 17 into the ink-refilling opening 1*a* and to finally draw the nozzle 17 from the ink-refilling opening 1*a* in response to the output of the ink-full sensor 9*a*.

Figure 5:
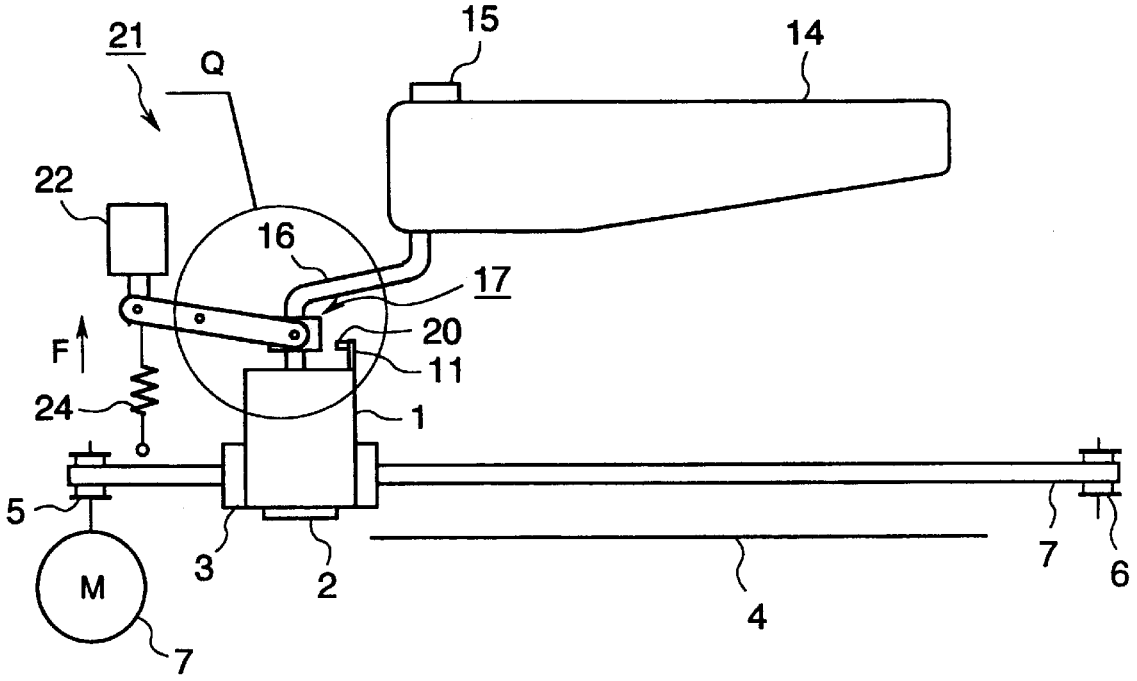
FIG. 5 illustrates the print head and ink tank at the ink-filling position.

The ink-refilling position is sufficiently away from the print area as shown in FIG. 5. When the output of the ink-empty sensor 10*a* indicates that the ink in the ink tank 1 has decreased to the lower limit, the CPU 32 calculates an amount of rotation of the spacing motor 8 on the basis of data stored in the memory 33 and the current location of the print head 2, the amount of rotation corresponding to the distance from the current position of the print head 2 to the ink-refilling position. Then, the CPU 32 causes the spacing motor 8 to rotate by that amount.

Figure 6:
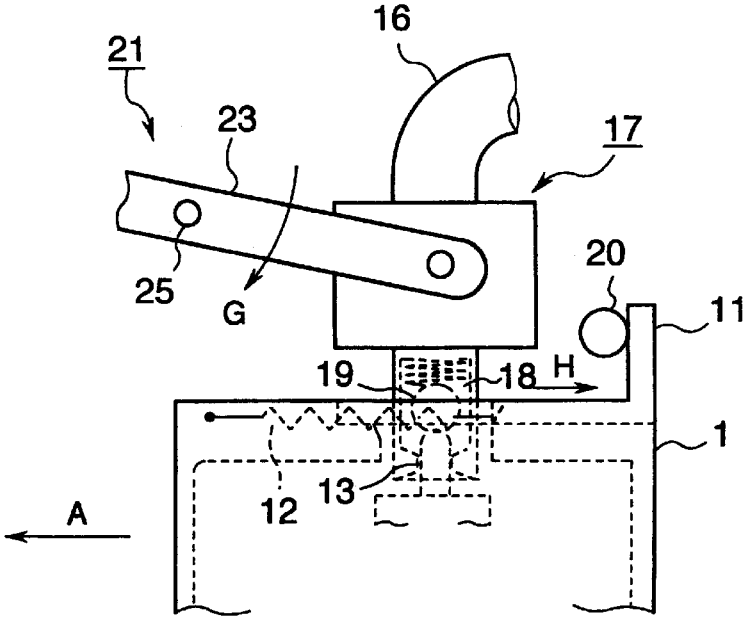
FIG. 6 is an enlarged view of an encircled portion indicated by Q in FIG. 5.

FIG. 5 illustrates the nozzle driver 21 when ink is being replenished at the ink-refilling position. FIG. 6 is an enlarged view of an encircled portion indicated by Q in FIG. 5.

When the carriage 3 moves past the knock pin 20 in the direction shown by arrow A, the knock pin 20 located near the nozzle 17 engages the lid 11 of the ink tank 1, causing the lid 11 to move in a direction shown by arrow 11 (FIG. 6). Thus, the lid 11 opens the ink-refilling opening 1*a* of the ink tank 1. The carriage 3 further moves to place the ink-refilling opening 1*a* at the ink-refilling position. Upon being energized, the electromagnetic solenoid 22 causes the movable rod 22*a* to move in a direction shown by F (FIG. 5), so that the lever 23 is rotated about the shaft 25 in a direction shown by arrow G (FIG. 6) inserting the nozzle 17 into the ink-refilling opening 1*a*. As the tip end portion of the nozzle 17 enters the ink tank 1 through the ink-refilling opening 1*a*, the projection 13 pushes the ball 19 upward to cause the ink to flow from the ink reservoir 14 into the ink tank 1.

Figure 7:
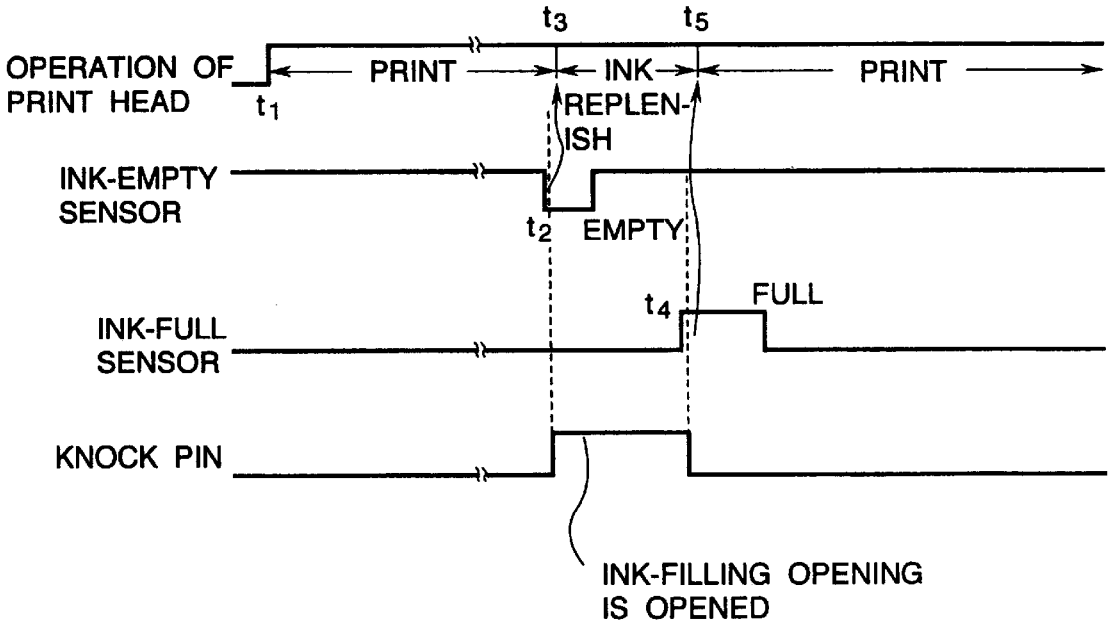
FIG. 7 is a timing chart illustrating the operation of the first embodiment.

FIG. 7 is a timing chart illustrating the operation of the first embodiment. Respective signals represent the operations of the print head 2, ink-empty sensor 10*a*, ink-full sensor 9*a*, and knock pin 20. The print head 2 starts the printing operation at time $t_1$, and the ink-empty sensor 10*a* detects when the ink in the ink tank 1 has decreased to the lower limit at time $t_2$. The print head 2 halts the printing operation at time $t_3$ and is subsequently moved by the spacing motor 8 to the ink-refilling position for refilling the ink tank 1. Then, the knock pin 20 abuts the lid 11 to open the ink-refilling opening 1*a*, the nozzle 17 is inserted into the ink-refilling opening 1*a*, the ball 19 is pushed up, and the ink-refilling operation begins.

The ink-full sensor 9*a* detects at time $t_4$ when the ink tank 1 has been filled with ink to the upper limit. The nozzle 17 is lifted, releasing the ball 19 downward to close the nozzle hole. Thereafter, the spacing motor 8 moves the print head 2 back to where the print head 2 was for subsequent printing. The print head 2 resumes the printing operation at time $t_5$.

The operation of the first embodiment will now be described with reference to FIG. 8A. At step S1, the controller 30 checks the output of the ink-empty sensor 10*a* to determine whether the output indicates that the ink in the ink tank 1 has reached the lower limit. If the answer is YES at step S1, then the program proceeds to step S2.

At step S2, a check is made by the controller 30 to determine whether the print head 2 is printing a line. If the answer is YES at step S2, then the program proceeds to step S3 where the program waits till the printing operation of the line is completed and thereafter the program proceeds to step S4. If the answer is NO at step S2, then the program proceed to step S4. The answer NO at step S2 implies that, for example, the print head 2 has just finished the printing a line and is at the end of the line, may be on its way moving back to the starting position of the print area for printing the next line, may have just arrived at the starting position of the print area for printing the next line, or may have returned to the starting position after printing operation of a page. Thus, at step S4, the controller 30 calculates the distance to the ink-refilling position from the current position of the print head 2 on the basis of the data stored in the memory 33 and the current location of the print head. The distance is calculated in terms of the amount of rotation of the spacing motor 8. At step S5, the controller 30 causes the spacing motor 8 to move the carriage 3 in the direction shown by arrow A as shown in FIGS. 1 and 2, so that the ink-refilling opening 1*a* takes up the ink-refilling position. The carriage 3 is moved by the amount calculated at step S4. As the carriage 3 is moved toward the ink-refilling position, the knock pin 20 abuts the lid 11 to open the ink-refilling opening 1*a*.

At step S6, the controller 30 causes the electromagnetic solenoid 22 to be energized so that the nozzle 17 enters the ink-refilling opening 1*a*. As shown in FIG. 6, the projection 13 pushes up the ball 19 to open the nozzle 17, initiating the ink-refilling operation. The energization of the solenoid 22 is continued until the ink-full sensor 9*a* finds that the ink tank is full at step S7. At step S7, the controller 30 checks the output of the ink-full sensor 9*a* to determine whether the output indicates that the ink in the ink tank has reached the upper limit. If the answer is YES at step S7, then the program proceeds to step S8, and if NO, then the program returns to step S6. Then, at step S8, the controller 30 causes the electromagnetic solenoid 22 to be deenergized in order to disconnect the nozzle 17 from the ink-refilling opening 1*a*. At step S9, the controller 30 causes the spacing motor 8 to move the carriage 3 to the starting position of the print area and the printing operation is resumed.

Figure 8A:
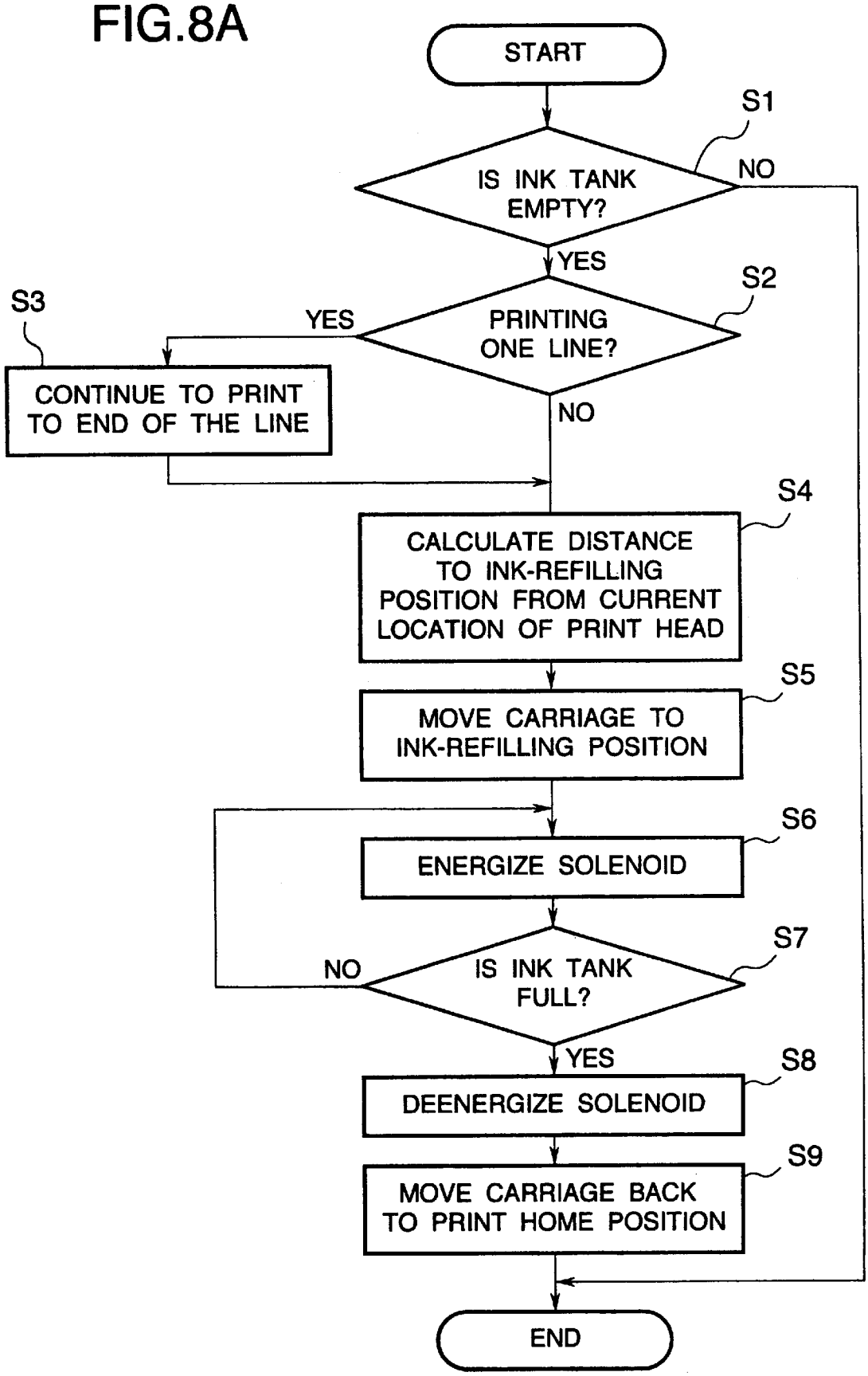
FIGS. 8A–8C are flowcharts illustrating the operation of the first embodiment.
Figure 8B:
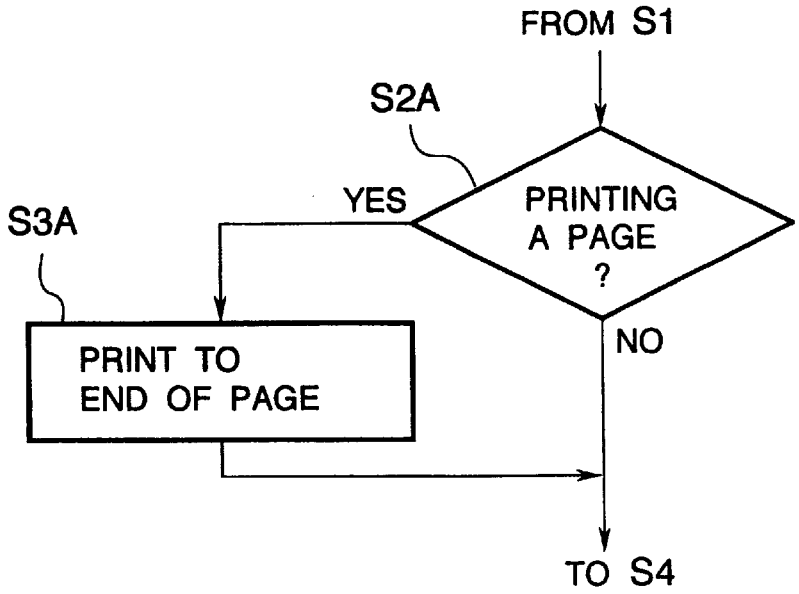

At steps S2–S3 in FIG. 8A, the program is designed to continue to print to the end of a line if the ink-empty sensor 10*a* detects decrease of the ink to the lower limit during printing of the line. The steps S2–S3 may be modified to steps S2A–S3A in FIG. 8B where the program continues to print to the end of the page currently being printed if the ink-empty sensor 10*a* detects when the ink in the ink tank 1 has decreased to the lower limit but the page is being printed.

Although, the lid 11 has an L-shaped cross section in one piece construction in the first embodiment, the lid 11 may be of two-piece construction where a flat plate is provided with a projection which abuts the knock pin 20 to open the ink-refilling opening 1*a*.

Figure 4B:
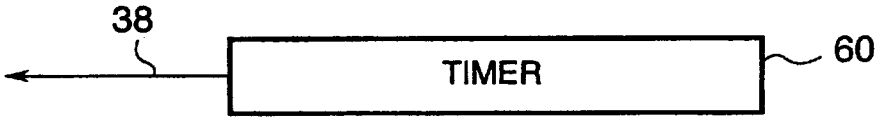
Figure 8C:
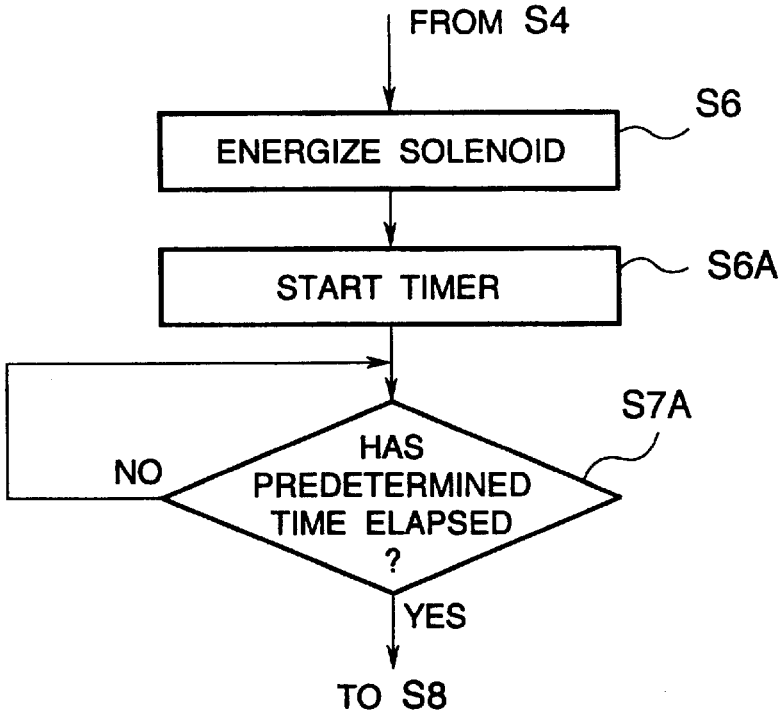

The ink-full sensor 9*a* used in the above embodiment may be omitted, and instead a timer 60 as shown in FIG. 4B is used. In this case, step S7 in FIG. 8A may be replaced by steps S6A and S7A in FIG. 8C. That is, when the electromagnetic solenoid 22 is energized (step S6), the timer 60 starts to count at step S6A. Then, a check is made at step S7A to determine whether a predetermined time has elapsed. Step S7A are repeated till the timer 60 counts up the predetermined time.

Second Embodiment

The first embodiment has been described with respect to a recording apparatus equipped with an ink tank filled with a single color ink. The present invention is also applicable to a recording apparatus equipped with a plurality of ink tanks each of which is filled with ink different in color from others.

Figure 9:
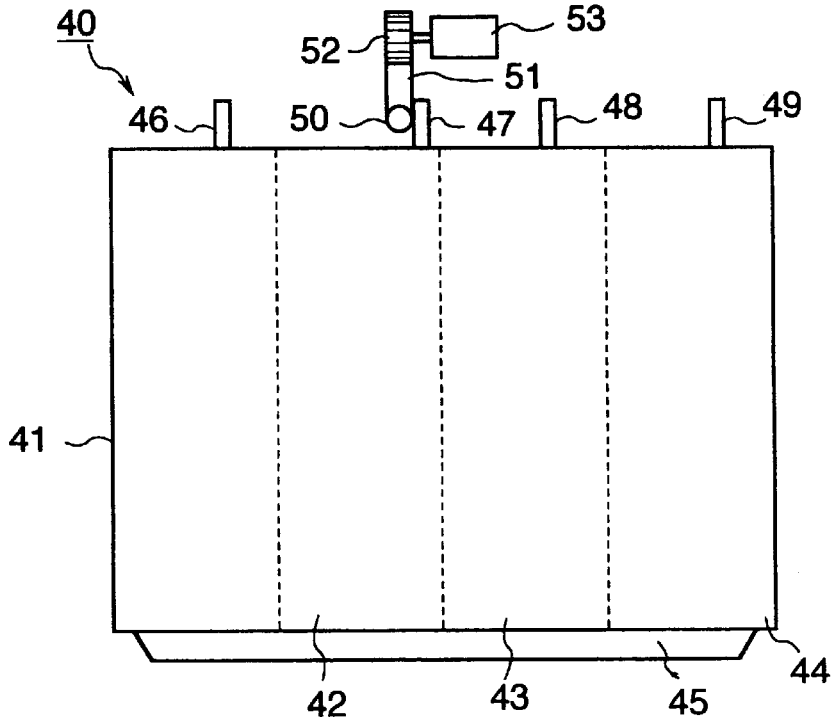
FIG. 9 is a plan view of a print head with ink tanks integrally constructed therewith according to a second embodiment.
Figure 10:
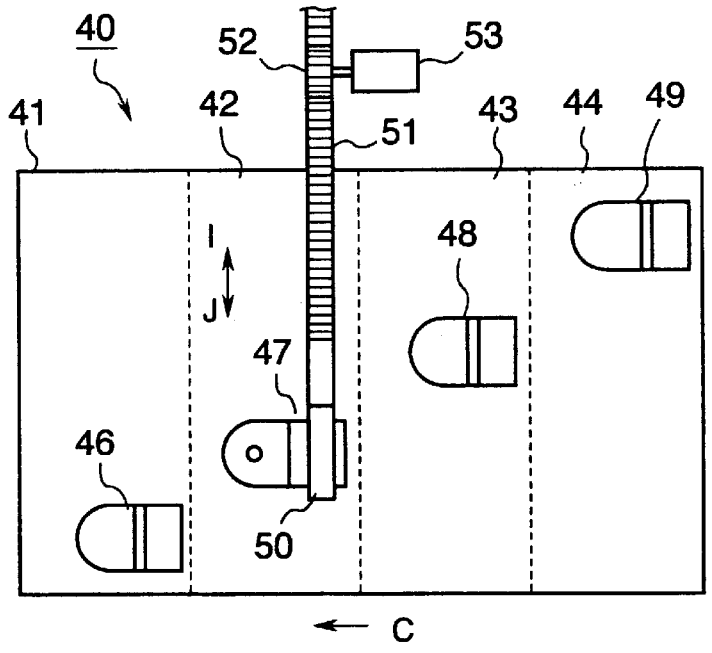
FIG. 10 is a top view of the print head in FIG. 9.

FIG. 9 is a plan view of a print head 40 with ink tanks 41–44 integrally constructed therewith according to a second embodiment. FIG. 10 is a top view of the print head 40 shown in FIG. 9. The print head 40 has ink tanks 41–44 filled with black-, yellow-, magenta-, and cyan-ink, respectively. Each ink tank has its ink-refilling opening provided with a lid 46–49 as shown in FIG. 10.

Figure 11:
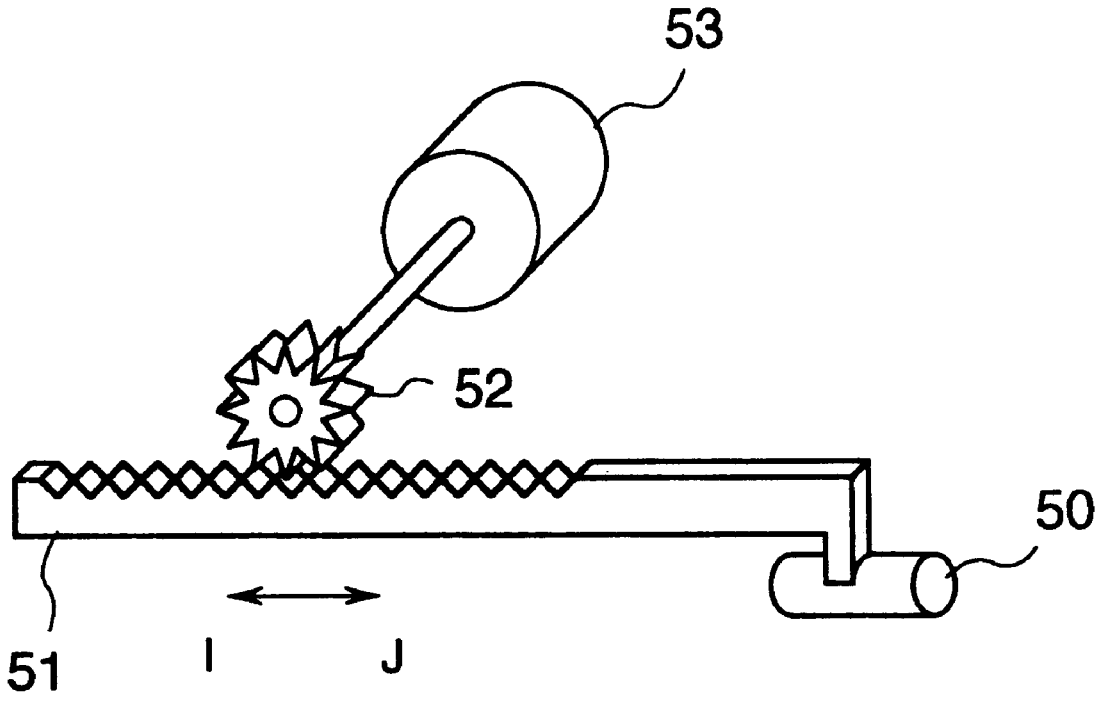
FIG. 11 illustrates a knock pin and a rack-and-pinion mechanism of the second embodiment.

As shown in FIG. 11, the knock pin 50 is secured to a longitudinal end of a rack 52 that engages a pinion 51 rotated by a stepping motor 53. The rack 51 and pinion 52 comprise a mechanism for converting rotational motion from the motor 53 to translational motion of the pin 50.

The knock pin 50 is moved longitudinally thereof in a direction shown by arrow J to a position where it abuts the lids 46–49 as the print head 40 is moved in the direction of arrow C, thereby opening the ink-refilling opening.

The lids 46 to 49 are staggered such that the lid 46 of the ink tank 41 at the front end with respect of the movement of the print head in the direction C, toward the ink-refilling position, is at a position farthest from the pinion 52. The lids 47 to 49 of the successive ink tanks 42 to 44 are at positions successively closer to the pinion. This is to prevent engagement of the knock pin 50 with any lid or lids of the ink tank or tanks positioned in front of the ink tank which needs refilling, while at the same time enable engagement of the knock pin 50 with the lid of the ink tank which needs refilling.

The knock pin 50 is moved in a direction shown by arrow I after refilling the ink tank. Each of the ink tanks 41–44 also has an ink-full sensor 9*a* and an ink-empty sensor 10*a* just as in the first embodiment. There are also provided an ink reservoir and a nozzle driver, not shown, which correspond to each of the ink tanks. The respective nozzle drivers are aligned in the direction parallel to the longitudinal direction of the rack 51, i.e., they are provided at the same position in the directions in which the carriage 3 is moved and therefore an amount of rotation of the spacing motor 8 varies depending on which ink tank is empty.

The operation of the second embodiment is the same as the first embodiment except that the controller 30 causes the stepping motor 53 to drive the rack-pinion mechanism to open and close the lids 46–49. When the output of any one of the ink-empty sensors 10*a* indicates that the ink in the corresponding ink tank has decreased to the lower limit, the CPU 32 reads from the memory 33 an amount of stroke through which the knock pin 50 must move to engage the lid of the ink tank which needs refilling, and calculates an amount of rotation of the spacing motor 8 on the basis of data stored in the memory 33 and the current location of the print head. The amount of rotation of the spacing motor 8 corresponds to the distance from where the ink tank which needs refilling was to the corresponding ink-refilling position.

In the second embodiment, if ink of a particular color is used more often than the other colors and therefore decreases to the lower limit faster than the other ink tanks, only that ink tank can be refilled with ink from the corresponding ink reservoir. This eliminates the need of discarding the whole ink cartridge after one of the ink tanks becomes empty while the other ink tanks of the same cartridge may still contain a considerable amount of ink.

What is claimed is:

1. A recording apparatus with an ink tank for supplying ink to a print head, the ink tank being carried together with the print head on a carriage movable along a path in a print area where the carriage is moved relative to a print medium to print data on the print medium and to a refilling position outside of the print area, the ink tank holding ink and having a predetermined lower limit for the ink, comprising:

an ink-empty sensor provided on the ink tank for outputting a first signal upon detecting when the ink in the ink tank has decreased to the predetermined lower limit;

an ink reservoir extending over the print area and located above the ink tank;

an ink-refilling mechanism for refilling the ink tank with ink from said ink reservoir when said ink-empty sensor outputs the first signal, said ink refilling mechanism having a nozzle, which communicates with said ink reservoir and is located at the refilling position outside of the print area and above the path in which the ink tank and print head are moved; and a knock pin projecting from a fixed or movable member;

wherein said ink tank has a lid, and said knock pin engages said lid to open said lid when the carriage is at the ink refilling position outside of the print area.

2. The recording apparatus according to claim 1, wherein said nozzle has an outlet which engages the ink tank to direct ink into the ink tank and said ink-refilling mechanism includes a flexible tube having two ends, the tube for directing the ink from said ink reservoir to said nozzle, said flexible tube having one end connected to said ink reservoir and the other end connected to said nozzle.

3. The recording apparatus according to claim 1, further including a controller connected to the ink-empty sensor for receiving the first signal and controlling refilling of the ink tank, wherein if the ink-empty sensor outputs the first signal when the carriage is moving relative to the print medium with the print head printing the data, the carriage continues to move so that the print head continues to print until a predetermined residual amount of data has been printed.

4. The recording apparatus according to claim 3, said ink-refilling mechanism starts refilling the ink tank with ink upon completion of printing of a line if said ink-empty sensor outputs the first signal while the line is being printed.

5. The recording apparatus according to claim 3, said ink-refilling mechanism starts refilling the ink tank with ink upon completion of printing of a page if said ink-empty sensor outputs the first signal while the page is being printed.

6. The recording apparatus according to claim 3, further including a timer for outputting an output signal a predetermined length of time after said ink-refilling mechanism starts to fill the ink tank with ink, and causes said ink-refilling mechanism to stop the refilling of ink in response to said timer output signal.

7. The recording apparatus according to claim 3, further including an ink-full sensor provided on the ink tank for outputting a second signal upon detecting when the ink in the ink-tank has increased to a predetermined upper limit, said ink-refilling mechanism stopping the refilling of ink in response to said second signal.

8. A recording apparatus with an ink tank for supplying ink to a print head, the ink tank being carried together with the print head on a carriage movable in a print area where the carriage is moved relative to a print medium to print data on the print medium and to a refilling position, the ink tank holding ink and having a predetermined lower limit for the ink and a predetermined upper limit for the ink comprising:

a lid provided on the ink tank to close the ink tank;

a knock pin projecting from a fixed or movable member and extendable substantially perpendicular to and into a path in which the carriage is moved, the knock pin engaging the lid to open the lid when the carriage is moved to the ink refilling position;

an ink-empty sensor provided on the ink tank for outputting a first signal upon detecting when the ink in the ink tank has decreased to a predetermined lower limit of the ink tank;

an ink reservoir extending over the print area and being located above the ink tank; and an ink refilling mechanism for refilling the ink from said ink reservoir when said ink-empty sensor outputs the first signal.

9. The recording apparatus according to claim 8, wherein there are provided a plurality of ink tanks which are filled with different colored inks and are aligned in a direction of movement of the carriage, the ink tanks each having lids, each lid being displaced ahead of a preceding one by said knock pin.

10. The recording apparatus according to claim 9, wherein said ink-refilling mechanism includes:

nozzle having an outlet which engages the ink tank to direct ink into the ink tank; and a flexible tube having two ends, the tube for directing the ink from said ink reservoir to said nozzle, said flexible tube having one end connected to said ink reservoir and the other end connected to said nozzle.

11. The recording apparatus according to claim 10, wherein said nozzle includes a spring and a ball mounted therein, said ball being urged by said spring against the outlet of said nozzle to close the outlet, and wherein said ink tank includes a projection having a free end portion extending upwardly therefrom in the ink tank so that the free end portion pushes up said ball against spring when said nozzle engages the ink tank, thereby opening the outlet to direct the ink into the ink tank.

12. The recording apparatus according to claim 11, further including a portion of each of the lids extending outwardly, a knock pin moving mechanism for causing the knock pin to extend a predetermined distance to engage the outwardly extending portions of the lids, said knock pin moving the predetermined distance in accordance with the ink tanks to be refilled.

13. The recording apparatus according to claim 12 wherein said knock pin moving mechanism is a rack-pinion mechanism having a rack portion and a pinion portion, said knock pin being attached to a tip end portion of said rack portion.

14. The recording apparatus according to claim 13, wherein said knock pin moving mechanism further includes a stepping motor connected to said pinion portion.

15. The recording apparatus according to claim 9, further including a controller connected to the ink-empty sensor for receiving the first signal and controlling refilling of the ink tank, wherein said ink-refilling mechanism starts refilling the ink tank with ink upon completion of printing of a line if said ink-empty sensor outputs the first signal while the line is being printed.

16. The recording apparatus according to claim 15, further including a knock pin moving mechanism for causing the knock pin to extend a predetermined distance to engage the outwardly extending portions of the lids said knock pin moving the predetermined distance in accordance with the ink tanks to be refilled.

17. The recording apparatus according to claim 16 wherein said knock pin moving mechanism is a rack-pinion mechanism having a rack portion and a pinion portion, said knock pin being attached to a tip end portion of said rack portion.

18. The recording apparatus according to claim 17, wherein said knock pin moving mechanism further includes a stepping motor connected to said pinion portion.

19. The recording apparatus according to claim 9, further including a controller connected to the ink-empty sensor for receiving the first signal and controlling refilling of the ink tank, wherein said ink-refilling mechanism starts refilling the ink tank with ink upon completion of printing of a page if said ink-empty sensor outputs the first signal while the page is being printed.

20. The recording apparatus according to claim 19, further including a knock pin moving mechanism for causing the knock pin to extend a predetermined distance to engage the lids said knock pin moving the predetermined distance in accordance with the ink tanks to be refilled.

21. The recording apparatus according to claim 20 wherein said knock pin moving mechanism is a rack-pinion mechanism having a rack portion and a pinion portion, said knock pin being attached to a tip end portion of said rack portion.

22. The recording apparatus according to claim 21, wherein said knock pin moving mechanism further includes a stepping motor connected to said pinion portion.

* * * * *